US007823871B2

(12) United States Patent
Suzuki

(10) Patent No.: US 7,823,871 B2
(45) Date of Patent: Nov. 2, 2010

(54) SHEET FEEDING APPARATUS, HOUSING INCORPORATING THE SAME AND IMAGE FORMING APPARATUS

(75) Inventor: Tomoo Suzuki, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/405,479

(22) Filed: Mar. 17, 2009

(65) Prior Publication Data

US 2009/0236795 A1 Sep. 24, 2009

(30) Foreign Application Priority Data

Mar. 21, 2008 (JP) ..... 2008-073132

(51) Int. Cl.
*B65H 3/12* (2006.01)
*B65H 3/14* (2006.01)
*B65H 1/00* (2006.01)

(52) U.S. Cl. ..... 271/94; 271/95; 271/98; 271/162

(58) Field of Classification Search ..... 271/94, 271/95, 98, 97, 162, 164
See application file for complete search history.

(56) References Cited

U.S. PATENT DOCUMENTS 5,090,676 A * 2/1992 Matsuno et al. ..... 271/12
6,318,052 B1 11/2001 Kuhar
6,412,769 B1 * 7/2002 Goda et al. ..... 271/94
7,472,904 B2 * 1/2009 Park ..... 271/117
2001/0017441 A1 * 8/2001 Yamaguchi et al. ..... 271/94
2007/0045932 A1 3/2007 Koga et al.
2007/0052152 A1 * 3/2007 Gruntjes et al. ..... 271/97
2007/0194514 A1 8/2007 Ikeda
2007/0228636 A1 10/2007 Koga
2008/0237968 A1 * 10/2008 Suzuki ..... 271/98

FOREIGN PATENT DOCUMENTS

EP 1108665 A2 6/2001
JP 9-86699 A 3/1997
JP 2004-131291 A 4/2004

OTHER PUBLICATIONS

European Search Report for Application No. 09154961.8-1240/2103999 mailed on Mar. 17, 2010.

* cited by examiner

*Primary Examiner*—David H Bollinger
(74) *Attorney, Agent, or Firm*—Cantor Colburn LLP

(57) ABSTRACT

A sheet feeding apparatus including a sheet tray for storing a plurality of sheets of paper, the sheet tray capable of being pulled out in a direction perpendicular to a sheet feed direction, a pair of side regulating members for regulating both lateral surfaces of the sheets, the regulating members being provided over the sheet tray and perpendicular to the sheet feed direction, a vacuum belt to suck a sheet of paper from above and feed the sheets, and a moving mechanism for moving the vacuum belt or one of the regulating members that is provided on a back side in the direction of pulling out the sheet tray in the vertical directions, in such a way that, when the sheet tray is pulled out, the uppermost end of the regulating member provided on the back side is lower than the lowermost surface of the vacuum belt.

12 Claims, 8 Drawing Sheets

SHEET FEEDING APPARATUS, HOUSING INCORPORATING THE SAME AND IMAGE FORMING APPARATUS

This application is based on Japanese Patent Application No. 2008-73132 filed on Mar. 21, 2008, the entire content of which is hereby incorporated by reference.

BACKGROUND OF THE INVENTION

1. Field of the Invention

The present invention relates to a sheet feeding apparatus wherein sheet-like paper is sucked and fed by a vacuum type belt from above the sheet bundle stacked on a sheet tray, and sent to a sheet feeding apparatus and image forming apparatus of a photocopier, printer, facsimile, printing machine and others which are provided with this sheet feeding apparatus.

2. Description of Related Art

One of the sheet feeding apparatuses known in the conventional art is the one having a sheet tray capable of stacking sheet-like paper wherein paper is sucked on a vacuum type belt using negative pressure and is fed in a predetermined direction. An image forming apparatus having such a sheet feeding apparatus is also known.

For example, the Japanese Unexamined Patent Application Publication No. 9-86699 proposes a sheet feeding apparatus including: a sheet stacking device; a side regulating device for regulating the position perpendicular to the direction of feeding the sheet on the sheet stacking device; a feed device for feeding the vacuum-sucking and feeding the lowermost one of the stacked sheets; and a separation device wherein air is jetted onto the side of the sheets on the sheet stacking device to separate the sheet having been vacuum-sucked by the feed device from other sheets.

The feed apparatus disclosed in the Japanese Unexamined Patent Application Publication No. 9-86699 is considered to provide an excellent technique wherein the lowermost of the sheets is sucked by the feed device and separated from other sheets independently of the type of sheet, and the lowermost sheet having been separated is fed correctly by the feed device.

As one form of the specification, a sheet feeding apparatus can be designed in such a way that the vacuum type belt is arranged to ensure that paper is sucked from above the sheet bundle and is fed. This arrangement, however, is not intended in the Japanese Unexamined Patent Application Publication No. 9-86699.

As described above, the applicants of the present invention have manufactured a sheet feeding apparatus wherein a vacuum type belt is arranged above the stacked sheets of paper and the uppermost sheet of paper is sucked by this vacuum type belt and is separated, and have conducted sheet feed tests using a large quantity of paper.

However, the aforementioned applicants have encountered the problem wherein the smooth feed of sheets of paper cannot be achieved sometimes.

To put it more specifically, there is a problem wherein the side edge of paper is displaced beyond the side regulating member through a slight clearance between the lowermost surface of the vacuum type belt opposed to the uppermost paper, and the top end of the side regulating member for regulating the side of the paper, is provided perpendicular to the direction wherein paper is fed.

In the meantime, a sheet tray capable of stacking and storing sheets of paper is provided as a constituent component of the sheet feeding apparatus. It is preferred from the view of conveyance to arrange this sheet tray in such a way that the sheet tray can be inserted or removed in the lateral direction (i.e., can be pulled out in the direction of the front door) by opening the door on the front of the image forming apparatus or the housing incorporating the sheet tray.

However, to prevent the displacement (misalignment) of the sheet mentioned above, it is necessary to ensure that the top end of the side regulating member is higher than the lowermost surface of the vacuum type belt. If this requirement is met, however, difficulties will be encountered in the insertion and removal of the sheet tray.

To find out the documents wherein such problems were disclosed, terms were set as appropriate according to the International Patent Classifications G03G, B65H and B41J, and a search was carried out to check the Abstract and Claim. However, no such documents have been found.

SUMMARY

In view of the prior art problems described above, it is the major object of the present invention to provide a sheet feeding apparatus wherein paper displacement and loss can be prevented by a simple structure, and the sheet tray can be pulled out perpendicular to the direction where paper is fed.

To achieve at least one of the abovementioned objects, an sheet feeding apparatus reflecting one aspect of the present invention comprises:

a sheet tray for stacking and storing a plurality of sheets of paper, the sheet tray capable of being pulled out in a direction perpendicular to a sheet feed direction;

a pair of side regulating members for regulating both lateral surfaces of the sheets, the regulating members being provided over the sheet tray and perpendicular to the sheet feed direction;

a vacuum type belt provided between the pair of side regulating members to suck a sheet of paper from above the sheets of paper stacked on the sheet tray and feed the sheets of paper; and a moving mechanism for moving one of the vacuum type belt and one of the side regulating members that is provided on a back side in the direction of pulling out the sheet tray in the vertical directions, in such a way that, when the feeding of sheets inside the sheet tray is enabled, the uppermost ends of the side regulating members are higher than the lowermost surface of the vacuum type belt and when the sheet tray is pulled out, the uppermost end of the side regulating member provided on the back side is lower than the lowermost surface of the vacuum type belt.

DESCRIPTION OF THE PREFERRED EMBODIMENTS

The following describes the embodiments of the present invention with reference to the drawings.

Figure 1:
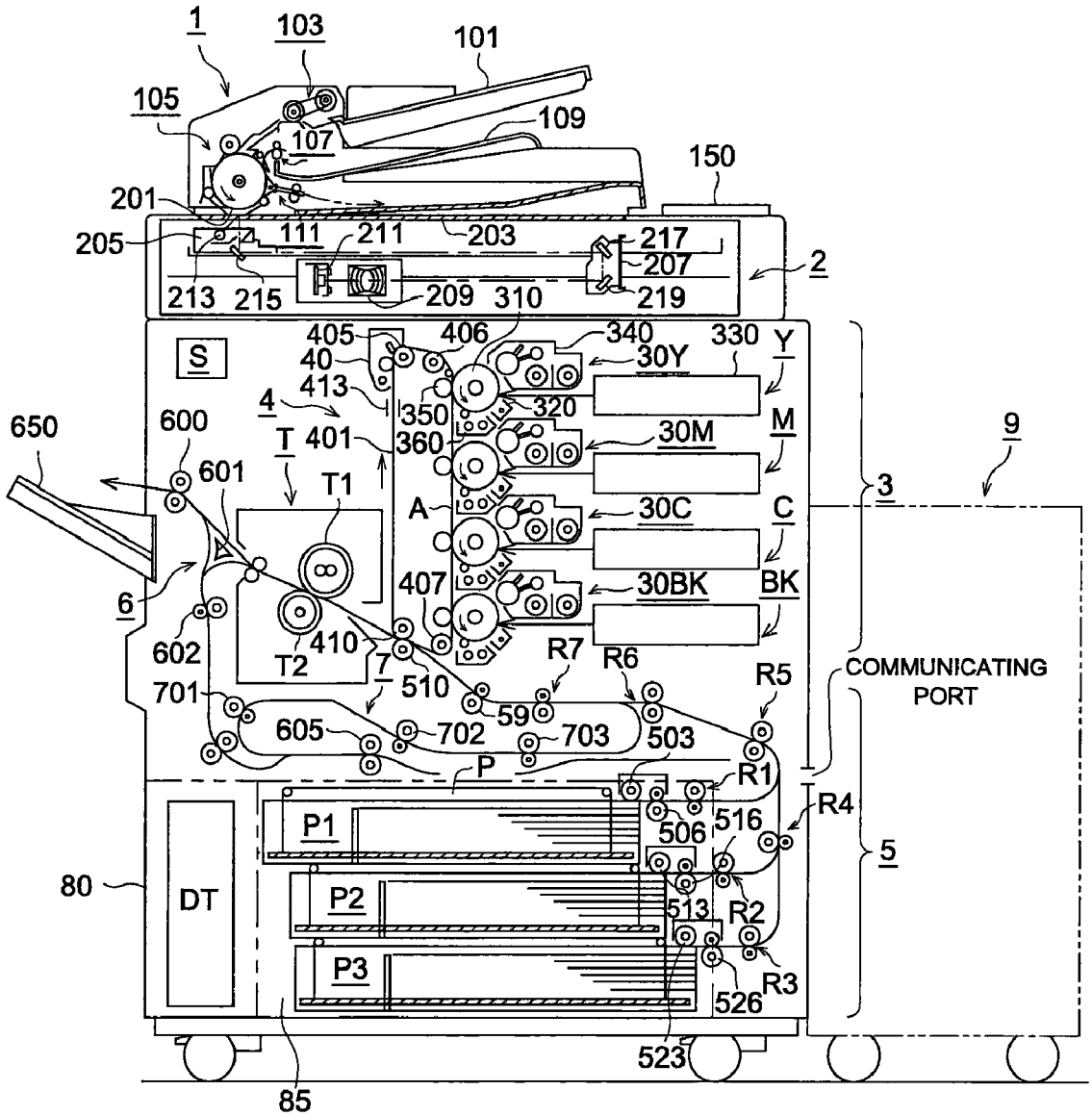
FIG. 1 is a general view representing the structure of an image forming apparatus made up of a digital color photocopier.

FIG. 1 is a general view representing the structure of an image forming apparatus made up of a digital color photocopier.

The image forming apparatus of FIG. 1 has a automatic document feed apparatus 1 provided on the top of the apparatus, and incorporates an image reading section 2, an image forming section 3, a belt installation section for the belt unit 4, a sheet feed section 5, a fixing apparatus T, a reverse ejection/sheet re-feed section 6, and an ADU 7 as a reverse conveyance device.

The automatic document feed apparatus 1 feeds out the documents one by one, and conveys it to the image reading position. Then the documents whose images have been read are ejected to a predetermined position by this apparatus.

The automatic document feed apparatus 1 includes a document placement table 101, a document separation device 103, a document conveyance section 105, a document ejection device 107, a document ejection stand 109, and a document reversing device 111 made up of a pair of rollers for reversing the documents in the duplex copying mode.

To describe from the viewpoint of the steps of processing, a plurality of documents (not illustrated) placed on the document placement table 101 are separated one by one by the document separation device 103 and are conveyed to the image reading position through the document conveyance section 105.

The document reading position is arranged below the document conveyance section 105, and a document image is read through the slit 201 constituting the image reading section 2. Then the documents having been read are ejected onto the document ejection stand 109 by the document ejection device 107.

After one side of the document has been read in the duplex copying mode, the document is conveyed in the direction marked by the arrow of a two-dot chain line by the document reversing device 111.

The document is again led to the image reading position through the document conveyance section 105 by the reverse rotation of the document reversing device 111 after the drive has been suspended in the state of sandwiching the trailing end of the document in the direction of travel. After that, the document is ejected onto the document ejection stand 109 by the document ejection device 107.

The aforementioned step is repeated the number of times corresponding to the number of documents placed on the document placement table 101.

The image reading section 2 includes a slit 201, a first mirror unit 205 integrally made up of a document irradiation lamp 213 and a first mirror 215 for reflecting the light reflected from the document, and a second mirror unit 207 integrally formed of a second mirror 217 and third mirror 219.

The image reading section 2 also includes an imaging lens 209 for ensuring that the light reflected from the third mirror 219 is imaged on the image pickup element, and a linear image pickup element (hereinafter referred to as "CCD") 211 for obtaining image information by photoelectric conversion of the optical image formed by the imaging lens 209.

After having been subjected to approximate image processing, the image information is stored in the memory in a control section S to be described later.

When the document fed by the automatic document feed apparatus 1 is read by the image reading section 2, the first mirror unit 205 and second mirror unit 207 are fixed at the illustrated position.

The image information for each color read by the image reading section 2 is sequentially read by the aforementioned memory and is inputted as an electric signal into the exposure optical system as an electrostatic latent image formation device for each color.

The image forming section 3 has four image forming devices 30 (30Y, 30M, 30C and 30BK: hereinafter referred to as "image forming unit") of Y (yellow), M (magenta), C (Cyan), and BK (Black) colors forming the toner image in conformity to the color-decomposed image.

Each of the image forming units 30 includes major components such as a photoreceptor drum 310 as an image carrier formed of a photosensitive layer being arranged on the drum-like metallic substrate, a charging device 320, an exposure optical system 330 as an image writing device, a development apparatus 340, transfer device 350, and a cleaning device 360.

The exposure optical system 330 is an exposure unit made up of a laser optical system.

In the drawing, reference numerals are assigned to the members constituting the yellow image forming unit. Since other image forming units are designed in a basically the same structure, reference numerals are omitted to simplify the drawing.

The aforementioned development apparatus 340 stores a two-component developer containing a magnetic carrier (hereinafter referred to as "carrier") and a non-magnetic carrier (hereinafter referred to as "toner").

The development apparatus 340 includes a developer carrier (hereinafter referred to as "development sleeve" or "sleeve") which is a rotatable and non-magnetic cylinder wherein a plurality of magnets (magnetic poles) are incorporated at fixed positions in the circumferential direction, and a toner density detecting device (not illustrated).

A plurality of magnets are arranged in such a way that the developer is held by the sleeve by magnetic adsorption, and is conveyed to the development area by the rotation of this sleeve. After that, the developer subsequent to completing the function of development is automatically removed from the sleeve by the repulsive magnetic field.

Bias voltage of a predetermined polarity (superimposition of DC voltage and AC voltage of negative polarity in this case) is applied to the aforementioned development sleeve of the development: apparatus 340 in the image forming operation. The details will not be described since the structure itself is well known.

In response to each development: apparatus 340, a toner replenishment apparatus is provided. This toner replenishment apparatus includes a toner bottle mounting section for rotatably mounting a toner bottle filled with the replenishment toner of each color, and a toner storage chamber for storing toner discharged from the toner bottle.

The aforementioned transfer device 350 is made of the roller opposed to part of the peripheral surface of the photoreceptor drum 310 through the intermediate transfer belt 401 to be described later. It can also be made of the normal transfer electrode including the electrode formed from a discharge wire.

The cleaning device 360 removes; the toner remaining on the photoreceptor drum 310 subsequent to the transfer step. The toner having been removed is fed downward through an appropriate pipe (not illustrated) and is stored in a waste toner box DT installed on the side of the sheet tray.

The image forming units 30 are arranged in the order of yellow (Y), magenta (M), cyan (C) and black (BK) as viewed from the top, along the traveling direction of one plane (belt tightened surface) A of the loop-like intermediate transfer belt 401 constituting the belt unit 4, provided in the longitudinal direction.

The belt unit 4 is composed of the intermediate transfer belt 401, supporting rollers 405, 406, and 407 for rotatably supporting the intermediate transfer belt, and a backup roller 410.

The secondary transfer device is composed of the backup roller 410 and intermediate transfer roller 510 which is arranged in the opposed position so as to rotate by pressing against the backup roller while sandwiching the intermediate transfer belt 401.

The following describes image formation using the aforementioned construction of the image forming unit 30 and belt unit 4.

The surface of the photoreceptor drum 310 rotating in the counterclockwise direction at the start of the image forming process is charged to have a predetermined polarity (negative polarity in this case) by the charging device 320.

Exposure corresponding to the first color signal due to the exposure optical system 330, i.e., the yellow (Y) image signal is provided, and the latent image corresponding to the yellow (Y) image is formed on the photoreceptor drum 310.

The latent image is subjected to reverse development by the contact or non-contact development process using the developer of the development apparatus 340, and is converted into the yellow (Y) toner image. After that, the image is transferred onto the intermediate transfer belt 401 by the function of the transfer device 350.

Image formation by color signals which is started sequentially at a predetermined time subsequent to the initiation of image formation by the first color signal is performed by the image forming units 30 of magenta (M), cyan (C), and black (BK) according to the same process as the above.

The toner images on the photoreceptor drum formed by respective image forming units are sequentially transferred to be superimposed with the image region containing the yellow (Y) toner image, whereby a superimposed color toner image is formed on the intermediate transfer belt 401.

The surface of the photoreceptor drum 310 subsequent to the transfer processing is cleaned bar a cleaning device 360, whereby preparation is made for formation of a new image.

The following describes the time of starting the image forming process on the photoreceptor drum 310 or intermediate transfer belt 401.

A registration sensor 413 is installed outside the intermediate transfer belt 401 in the zone ranging from the position of the transfer roller 510 to the position of the first (yellow) image forming unit, as viewed from the rotating direction of the intermediate transfer belt.

Counting is conducted with reference to the time when the reference mark arranged on the intermediate transfer belt 401 has been detected by the registration sensor 413, and (Y), (M), (C), and (BK) processes are started sequentially at every passage of a predetermined time.

The reference numeral S signifies the control device (hereinafter referred to as "control section") including the computer. This control section incorporates a machine operation program, and provides all forms of control, including the control of a series of image forming processes and the lock control of the sheet tray when the waste toner box is removed.

To put it another way, the control section S includes a CPU for computation control processing, a ROM storing various forms of operation programs, and a RAM storing the data on the results of computation.

The outputs of various types of sensors are input into the CPU through the interface, and the drive of the motor or display section is controlled based on the information.

The reference numerals P1, P2, and P3 indicate three sheet trays installed on the lower portions of the apparatus. These trays can be removed (pulled out) toward the front side in the drawing.

The DT indicates the waste toner box as mentioned above. This box is located on the side of the sheet trays P1 through P3, and can be removed (pulled out) in the same direction as that of the sheet tray.

The two-dot chain line surrounding the waste toner box DT and sheet trays P1 through P3 denotes the exterior door 80 covering the front surface of the storage section of the waste toner box DT, and the front door 85 covering the front surface of the sheet tray.

The feedout section of the sheet trays P1 through P3 is provided with sheet feed rollers 503 513, and 523, separation rollers 506, 516, and 526 and conveyance rollers R1, R2, and R3. The sheets P fed out by these rollers are conveyed along the sheet conveyance path provided with R4 through R7.

The reference numeral 59 denotes a registration roller, which is installed close to the secondary transfer section on the downstream side of the conveyance) roller R7.

A fixing apparatus T is installed downstream from the secondary transfer section (wherein a transfer roller 510 is located) along the sheet conveyance path. The major components of the fixing apparatus T include the first fixing roller T1 incorporating a heating source, and the second fixing roller T2 rotating in close contact with the first fixing roller.

The reference numeral 600 denotes an ejection roller, and 650 indicates an ejection tray for stacking and storing the sheets having been ejected.

The form or conveyance control of the sheet conveyance path of the reverse ejection/sheet re-feed section 6, and an ADU 7 is commonly known and is not directly related to the present invention. Accordingly, the description thereof will be omitted.

The following briefly describes the other structures with reference to the processes wherein the color toner image formed on the intermediate transfer belt 401 is transferred onto the paper as the transfer material, and the paper is ejected out of the apparatus.

The sheet P is fed by the roller 503 (513, 523) at an appropriate time interval conforming to the formation of an image on the intermediate transfer belt 401.

Then the sheet P is sandwiched and conveyed by the separation roller 506, and a plurality of conveyance rollers R1 through R7 arranged along the conveyance path, and is fed toward the registration roller 59 arranged in front of the transfer section (transfer region).

The sheet P to be fed is the sheet material having the dimensions specified and selected on the operation display plate 150 wherein the number of sheets to be recorded, recording startup button, magnification rate for recording, or image density can be set.

After the leading edge of the sheet P has come in contact with the registration roller 59, the sheet P is re-fed by the restart of rotation of the registration roller 59 at the time interval of superimposition with the color toner image region on the intermediate transfer belt 401.

The sheet P together with the intermediate transfer belt is pressed and sandwiched between the backup roller 410 and transfer roller 510 in the secondary transfer section. During this time, the color toner image on the intermediate transfer belt 401 is transferred onto the sheet P.

The structure is preferably designed in such a way that an appropriate transfer bias voltage should be applied to the transfer roller 510 at the time of transfer.

The sheet P with the toner image having been transferred thereon is separated from the intermediate transfer belt 401, and is conveyed toward the fixing apparatus T by the conveyance belt (not illustrated). The sheet P is heated and pressed, whereby toner is molten and is fixed on the sheet P.

After the fixing process has been completed by the fixing apparatus T, the sheet P is conveyed to the ejection roller 600 located downstream thereof, and is ejected onto the ejection tray 650 installed outside the apparatus.

After completion of the secondary transfer, the surface of the intermediate transfer belt 401 is cleaned by the cleaning device 40 and is made ready to carry a new toner image.

In FIG. 1, the illustrated position of the path switching member 601 indicates the position wherein the sheet P is rejected without being reversed onto the sheet P after fixing.

When the sheet is reversed and ejected, the path switching member 601 is rotated a predetermined amount and the sheet P is guided downward along the right side of the path switching member 601.

After the trailing end of the sheet P is sandwiched by the roller 602, the sheet P is fed upward by the reverse rotation of the roller pair 602 along the left side of the path switching member 601, and is ejected through the ejection roller 600.

Further, in the duplex copying mode using the ADU 7, sheet P with an image formed on one side thereof after completion of the fixing process is guided downward along the right side of the path switching member 601. Conveyance is suspended when the trailing end of the sheet P is sandwiched between the roller pair 605.

Then the roller pair 605 is rotated in the reverse direction and the sheet is moved upward along the guide plate (not illustrated). The sheet is then led to the ADU 7 containing a plurality of roller pairs 701, 702, and 703, whereby the sheet P is reversed.

The process of forming an image on the second surface of the sheet P is basically the same as the aforementioned process. Any one of the aforementioned paths is selected as the ejection path after the sheet has been fed out of the fixing apparatus T.

In the aforementioned image forming process, the toner density in the developer is detected by the toner density detecting sensor and the output information is put into the control section S, wherein computation is performed and comparison is made with the preset threshold value.

If the control section S has determined that toner replenishment is essential, a toner conveyance device is driven according to the command of the control section S, and the required amount of toner is supplied into the development apparatus 340.

In the meantime, the toner removed from the photoreceptor drum by the cleaning device 360 is conveyed to the waste toner box DT and is stored therein.

If the control section S has determined that a predetermined amount of waste toner has been stored in the waste toner box DT, this control section S controls the drive of the display section so that this notice will be displayed on the operation display plate 150, whereby the operator is notified of the need of replacing the waste toner box DT.

The reference numeral 9 denotes the housing incorporating the sheet feeding apparatus and sheet tray of the present invention. This housinghousing 9 is used in the form integrally combined with the image forming apparatus.

The sheet having been fed from the sheet tray in the housinghousing by the sheet feed device is conveyed by the appropriate conveyance roller and is fed into the image forming apparatus through a communicating port. The conveyance of this sheet is controlled in the same manner as that of the above-mentioned one. After a transfer image has been formed on a predetermined surface, this sheet is ejected onto the ejection tray 650.

Figure 2:
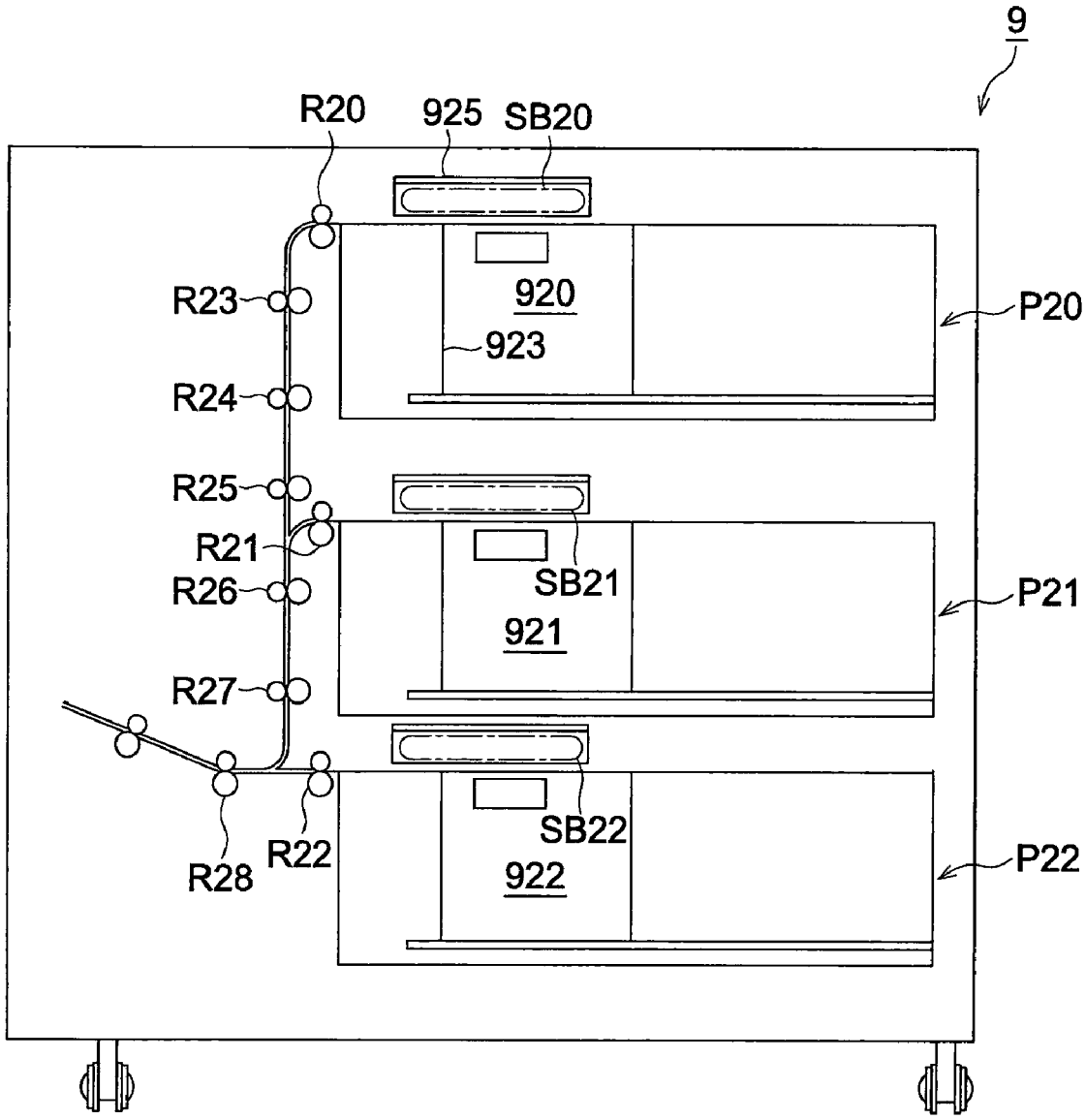
FIG. 2 is a general view showing the structure inside the housinghousing in an embodiment of the present invention.

FIG. 2 is a general view showing the structure inside the housinghousing of the present invention.

In FIG. 2, sheet trays P20, P21, and P22 are arranged in the vertical direction in the housinghousing 9. Endless vacuum type belts SB20, SB21, and SB22 are provided as sheet feed devices over the sheet tray.

The sheet trays P20 through P22 can be pulled out in the longitudinal direction of the drawing after opening the front door (not illustrated) on the front side of the drawing.

It is also possible to arrange such a configuration that an exterior panel is arranged on the front side of the sheet tray, and this exterior panel as provided with a knob or other device for gripping, so that this knob can be used for insertion or removal (pull-in and pull-put operations) of the sheet tray.

The sheet is supplied by the Vacuum type belts SB20 through SB22 in the direction (leftward in the drawing) perpendicular to the direction of pulling out the sheet tray P20.

The sheet P supplied from the sheet tray P20 by the vacuum type belt SB20 is sandwiched between the conveyance rollers R20 having a nip at almost the same height as that of the lowermost surface (surface opposed to the uppermost sheet of a sheet bundle) of the vacuum type belt SB20 on the left side of the drawing.

The sheet is conveyed by the conveyance rollers R20 and is then subjected to the action of the guide member (without reference numeral) so that the sheet is conveyed downward.

The sheet is conveyed downward by the conveyance rollers R23 through R27 arranged in the vertical direction and is then led to the left of the drawing by the guide member (without reference numeral). After that, the leading edge of the sheet comes in contact with the conveyance roller R28 which is not rotating.

The conveyance roller R28 serves as a registration roller to be synchronized with the image forming process.

After that, with the start of rotation of the conveyance roller 28 and others, the sheet P is fed into the image forming apparatus. This sheet supply control is provided by the above-mentioned control section S.

Similarly, the sheet P supplied from the sheet tray P21 by the vacuum type belt SB21 is conveyed by being sandwiched between the conveyance roller R21 having a nip at almost the same height as that of the lowermost surface of the vacuum type belt SB21 on the left side of the drawing.

After that, the sheet is subjected to the action of the guide member (without reference numeral) and is conveyed downward by the conveyance rollers R26 and R27. The sheet is stopped as the leading edge thereof is kept in contact with the conveyance roller R28, and is then fed into the image forming apparatus with the start of rotation of the conveyance roller R28.

Further, the sheet P supplied from the sheet tray P22 by the vacuum type belt SB22 is conveyed by being sandwiched between the conveyance roller R21 having a nip at almost the same height as that of the lowermost surface of the vacuum type belt SB21 on the left side of the drawing.

The sheet is then stopped as the leading edge is brought in contact with the conveyance roller R28 having almost the same height, and is fed into the image forming apparatus with the start of rotation of the conveyance roller R28.

As can be seen from the above description, the sheet feeding apparatus of the present invention includes the major components of a sheet tray, vacuum type belt, and a plurality of conveyance rollers.

The following describes the relationship between the vacuum type belt and paper side regulating member.

The top of the sheet trays P20 through P22 are provided with movable side regulating members 920 through 922 for regulating the sheet side, which are arranged perpendicular to the feed direction of the sheet.

Pairs of the side regulating members 920 through 922 are arranged opposite to each other in the form sandwiching the vacuum type belts SB20 through SB22, as viewed from the top of the drawing.

The side regulating member in the sheet feed direction has the length to cover the sucking portion of the vacuum type belt in the sheet feed direction.

The sheet trays P20 through P22 are arranged at predetermined positions. The uppermost end of the side regulating members 920 through 922 are located higher than the lowermost surface of the vacuum type belt when the sheet can be fed by the vacuum type belts SB20 through SB22.

Figure 3:
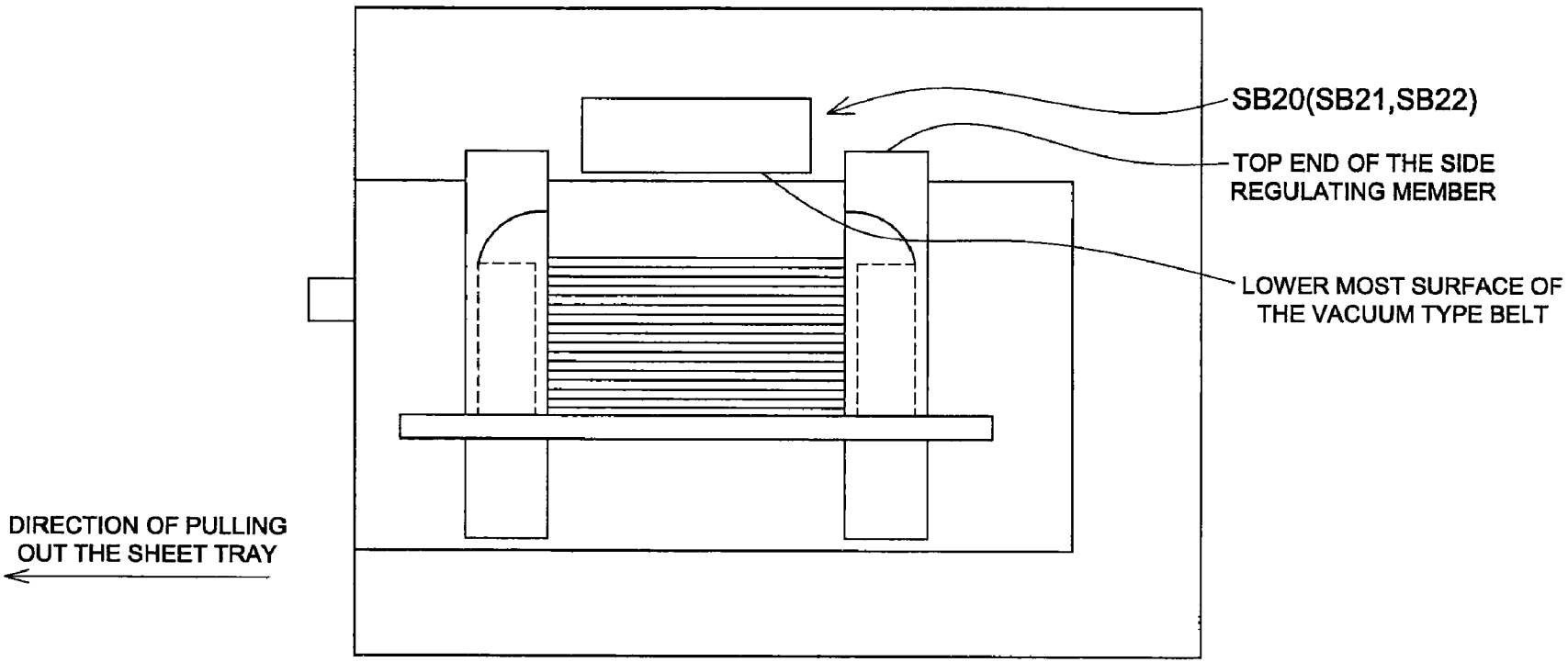
FIG. 3 is a schematic diagram showing the positional relationship between the uppermost end of the side regulating member and the lowermost surface of the vacuum type belt along the height (in the vertical direction)

To put it another way, as shown in the schematic diagram of FIG. 3, the uppermost end of the side regulating member is higher than the lowermost surface of the vacuum type belt opposed to the uppermost sheet of a sheet bundle.

The position of the leading edge of the sheet P in the sheet feed direction is controlled by the front wall (not illustrated) arranged on the surface perpendicular to the left end position 923 of the side regulating members 920 through 922.

The front wall is located inside, close to one end of the suction region of the vacuum type belts SB20 through SB22.

Figure 4:
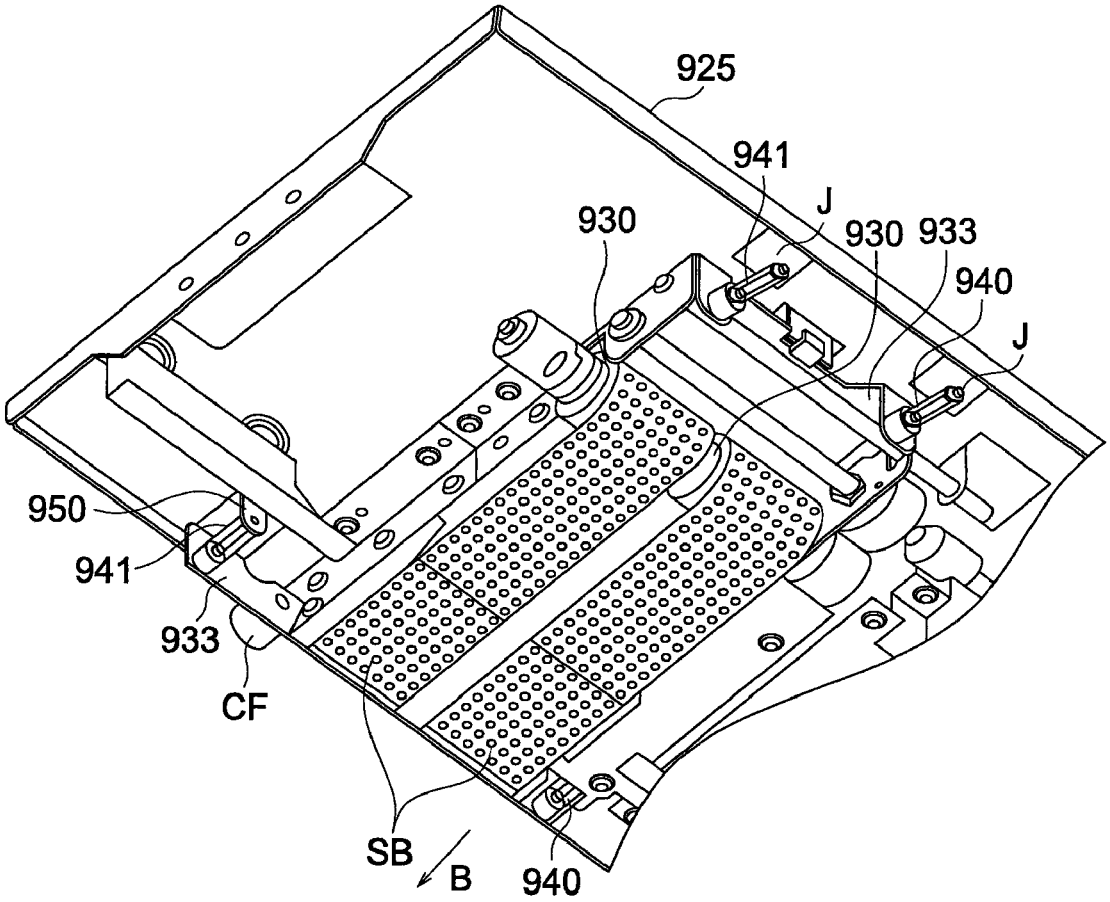
FIG. 4 is a partial view of the belt holding member holding the vacuum type belt, as seen from the bottom.
Figure 5:
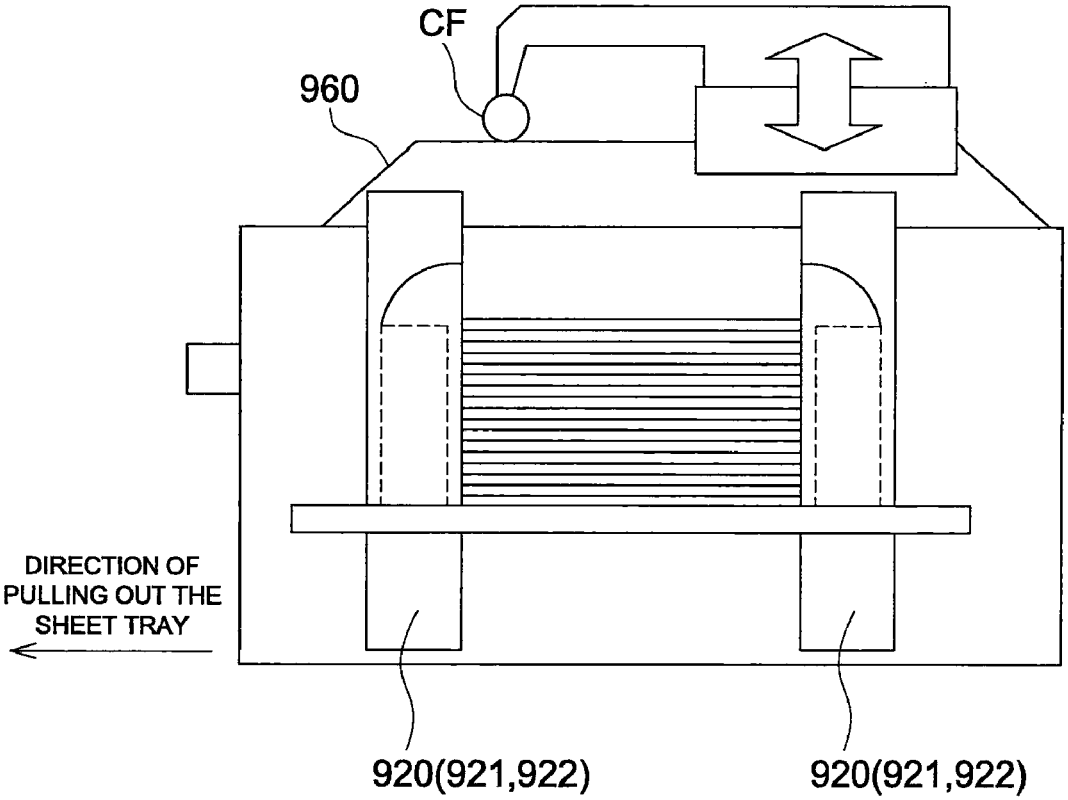
FIG. 5 is a conceptual diagram showing that the sheet tray is being pulled out.

Referring to FIG. 4 and FIG. 5, the following describes the relationship between the sheet tray and vacuum type belt.

FIG. 4 is a partial view of the belt holding member holding the vacuum type belt, as seen from the bottom, and FIG. 5 is a conceptual diagram showing that the sheet tray is being pulled out.

In FIG. 4, a belt holding member 925 is made of a plate stock and is secured onto the fixing portion of the housing-housing 9 by screws. The belt holding member 925 holds the vacuum type belt SB20 (SB21 and SB22: hereinafter referred to as "vacuum type belt SB" when the vacuum type belt need not be specified) in a suspended state through the vacuum type belt holding frame.

The vacuum type belt SB is formed by the parallel arrangement of two bolts with a great number of pores formed thereon, and is applied to a drive roller 930 and driven roller (without reference numeral).

The vacuum type belt SB is provided with reference to the center, and the dimension across the width (perpendicular to the sheet feed direction) in the present embodiment is set smaller than the dimension of the short side of a postcard.

The dimensions of the vacuum type belt SB in the direction of width and sheet feed can be determined to a proper level in conformity to the specifications. The minimum dimension that can be used in the present embodiment is that of a postcard of the specification of longitudinal feed (wherein the long side is parallel to the sheet feed direction when the sheet is fed).

The internal space formed on the vacuum type belt SB is provided with a negative pressure source for sucking and holding the sheet on the vacuum type belt, the negative pressure source being exemplified by a duct box connected to the casing incorporating a sirocco fan F1 (not illustrated).

Shafts (pins) J are planted onto four positions on the vacuum type belt holding frame 933, and one end of each of the arms 940 and 941 is arranged in the form idle-fitted with the shaft J.

The other end of each of the arms 940 and 941 is arranged in the form idle-fitted with the shaft J on the folded portion 950 formed on the belt holding member 925.

The aforementioned structure ensures that the shaft J on the folded portion 950 serves as a swinging fulcrum when the vacuum type belt SB or the vacuum type belt holding frame is moved.

A cam follower CF is rotatably provided on the belt holding frame 933 downstream in the sheet feed direction B.

In the meantime, the sheet tray P20 (P21, P22) opposed to the cam follower CF is provided with a cam having the length and shape appropriate in the direction of insertion and removal.

This cam can be an approximately trapezoidal cam 960 as shown in FIG. 5.

The following describes the operation of the related members (devices) when the sheet tray is inserted or removed in the sheet feeding apparatus having the aforementioned structure.

Immediately when the sheet tray P20 (P21, P22) has been pulled out in a predetermined direction from the position illustrated in FIG. 2 or FIG. 3, the cam follower CF runs onto the inclined slope (ascent) of the cam 960, as shown in FIG. 5.

To be more specific, the cam follower CF is gradually pushed up by the cam 960. This push-up force is conveyed to the arms 940 and 941 through the vacuum type belt holding frame 933.

The arms 940 and 941 are rocked (rotated) in the clockwise direction from the position of FIG. 4, using the shaft J on the folded portion 950 of the belt holding member 925 as a fulcrum. As a result, the vacuum type belt SB is shifted upward through the vacuum type belt holding frame 933.

When the cam follower CF runs onto the horizontal portion of the cam 960 thereafter, the rocking motion of the arms 940 and 941 stops.

When the cam follower CF has run onto the horizontal portion of the cam 960, the lowermost surface of the vacuum type belt SB is higher than the uppermost end of the side regulating member 920 (921, 922), and a step has been take to complete a shift to the position wherein the pull-out operation of the sheet tray is not interrupted.

For example, when the sheet P has a postcard size as the minimum dimension, the side regulating member on the back is located close to the end of the vacuum type belt which is opposed to the side regulating member, but it is necessary to assign the vacuum type belt with the aforementioned distance of travel, while the sheet tray travels this distance.

When the sheet tray is further pulled out, the cam follower CF comes down along the second inclined slope of the cam 960. The vacuum type belt SB soon returns to the initial status.

For example, when the sheet tray P20 (P21, P22) has been inserted into the housing 9 subsequent to the step of replenishment or replacement of sheets P, the vacuum type belt SB is fed upward through the vacuum type belt holding frame 933 and others, and shift of the position then stops Then the belt is brought back to the initial position.

To be more specific, subjected to the action of the second inclined slope of the cam 960, the vacuum type belt SB is moved upward, and the shift of position is stopped by the action of the horizontal portion of the cam.

The distance of upward travel is such that the lowermost surface of the vacuum type belt does not come into collision with the uppermost end of the side regulating member on the back. As described above, this traveling terminates before the side regulating member on the back reaches the end of the vacuum type belt on the side opposed to the side regulating member.

When the side regulating member 920 (921, 922) on the back has traveled beyond the region wherein the vacuum type belt SB is applied, and there is no obstacle in the traveling path of the sheet tray, the cam follower CF is subjected to the inclined slope (descent). The vacuum type belt is fed downward and is returned to the position wherein initial sheet feed can be performed.

To be more specific, the lowermost surface of the vacuum type belt is located lower than the uppermost end of the side regulating member, and the belt is kept at the sheet feed position.

As will be apparent from the above description, the cam 960 and cam follower CF arranged between the sheet tray and vacuum type belt sides constitute a vacuum type belt moving device as a moving mechanism to move the vacuum type belt SB in the vertical direction.

Figure 6:
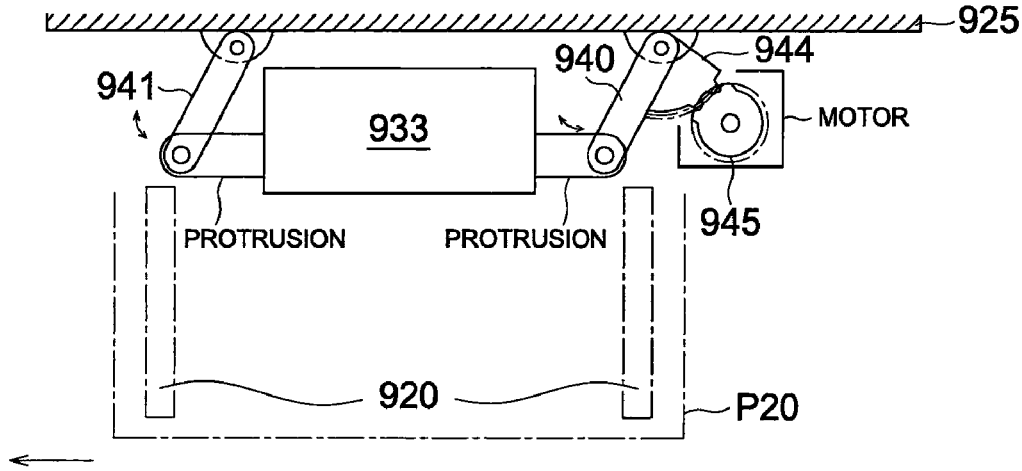
FIG. 6 is a diagram schematically showing the relationship between the vacuum type belt holding frame and vacuum type belt moving device.

One of the arrangements to move the vacuum type belt SB is shown in FIG. 6.

FIG. 6 is a diagram schematically showing the relationship between the vacuum type belt holding frame and vacuum type belt moving device.

The vacuum type belt is moved through the vacuum type belt holding frame that holds this vacuum type belt, similarly to the aforementioned first structure.

The members (devices) having the same functions as those of the members (devices) already described are assigned with the same reference numerals.

The vacuum type belt holding frame 933 has tabular protrusions at four corners of the holding frame. Each of these protrusions is connected with one end of each of the arms 940 and 941 to permit relative movement.

The other end of each of the arms 940 and 941 is mounted rotatably with respect to the belt holding member 925.

One of the arms 940 is provided with a sector gear 944, and this sector gear 944 is meshed with the gear 945 arranged on the output shaft of the motor.

In the aforementioned structure, when the sheet tray P20 is pulled out in the direction of the arrow, the motor is started and the vacuum type belt holding frame is moved to the upper left through the gear 945, sector gear 944, and arms 940 and 941.

The distance of the vacuum type belt holding frame 933 in the vertical direction is such that the lowermost surface of the vacuum type belt SB located lower than the uppermost end of the side regulating member is higher than the uppermost end of the side regulating member.

In the aforementioned embodiment, only the side regulating member on the back interferes with the vacuum type belt during the movement of the sheet tray. Accordingly, when the sheet tray is pulled out, it is only required that the lowermost surface of the vacuum type belt SB should be located higher than at least the uppermost end of the side regulating member on the back in the direction of pulling out the sheet tray.

Conversely to the aforementioned structure, it is also possible to arrange such a configuration that the position of the vacuum type belt is fixed and the side regulating member is moved in the vertical direction. The intended object can be achieved by this structure as well.

Figure 7:
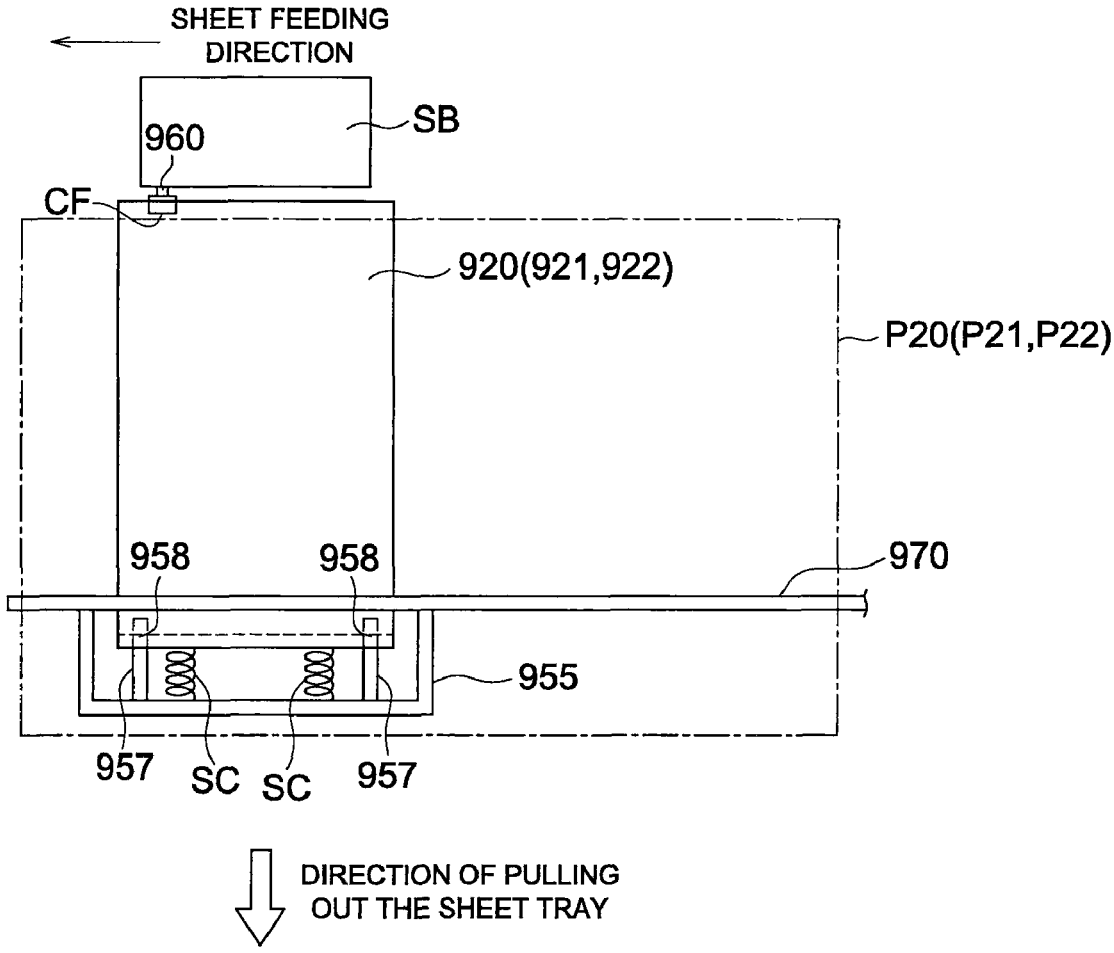
FIG. 7 is a conceptual diagram showing the second embodiment of the moving device for moving the side regulating member in the vertical direction.

FIG. 7 is a conceptual diagram showing the second embodiment of the moving device as a moving mechanism for moving the side regulating member in the vertical direction.

In this embodiment, only the side regulating member on the back requires movement in the vertical direction in order to avoid interruption with the vacuum type belt during the movement of the sheet tray. Thus, the side regulating member on the front side is not illustrated.

The lower end of the side regulating member 920 (921, 922) on the back is provided with a box 955 that restricts the lowering of the elevating plate to be described later, wherein this box is movable integrally. This box incorporates an elastic body made of a spring coil SC.

A guide member is provided to ensure stable displacement of the side regulating member in the vertical direction.

The guide member can be formed, for example, by fitting the pin 957 planted on the bottom wall of the box 955 with the hole 958 formed on the external folded portion of the side regulating member.

The spring coil SC constantly applies bias to the side regulating member in the upward direction in the drawing.

The reference numeral 955 is an elevating plate capable of carrying paper, and this plate is raised with the decrease in the number of stacked sheets of paper. Control is provided to ensure that the uppermost sheet of paper is located at a predetermined height. Conventionally known techniques can be used for this control, and a detailed description will be omitted.

The top of the side regulating member is provided with a cam follower CF (made of a rotatable roller, similar to the one of the embodiment in FIG. 5). A cam 960 for driving this cam follower CF is arranged on the side of the vacuum type belt SB.

The relationship between the cam and cam follower has already been described with reference to the first embodiment and is not shown in the drawing. It can be shown by reversing the installation members of the trapezoidal cam and cam follower in FIG. 5. The vacuum type belt SB or vacuum type belt holding frame are held at fixed positions in the housing 9.

Thus, the upward traveling of the side regulating member by the bias given by the spring coil SC is restricted by the contact between the cam and cam follower.

For example, as the sheet tray P20 is pulled out, the cam follower CF is subjected to the downward pressure against the bias of the spring coil by the inclined slope of the cam 960, with the result that the side regulating member is moved downward.

Then on the horizontal plane of the cam 960, the side regulating member 920 (921, 922) performs the maximum downward movement, and the member is returned to the same position as when installation has been completed, along the second inclined slope by the bias of the spring coil SC.

To be more specific, the uppermost end of the side regulating member is higher than the lowermost surface of the vacuum type belt SB.

When the sheet tray P20 is installed (pushed into position), the behavior of the side regulating member is the reverse of the aforementioned behavior.

Figure 8:
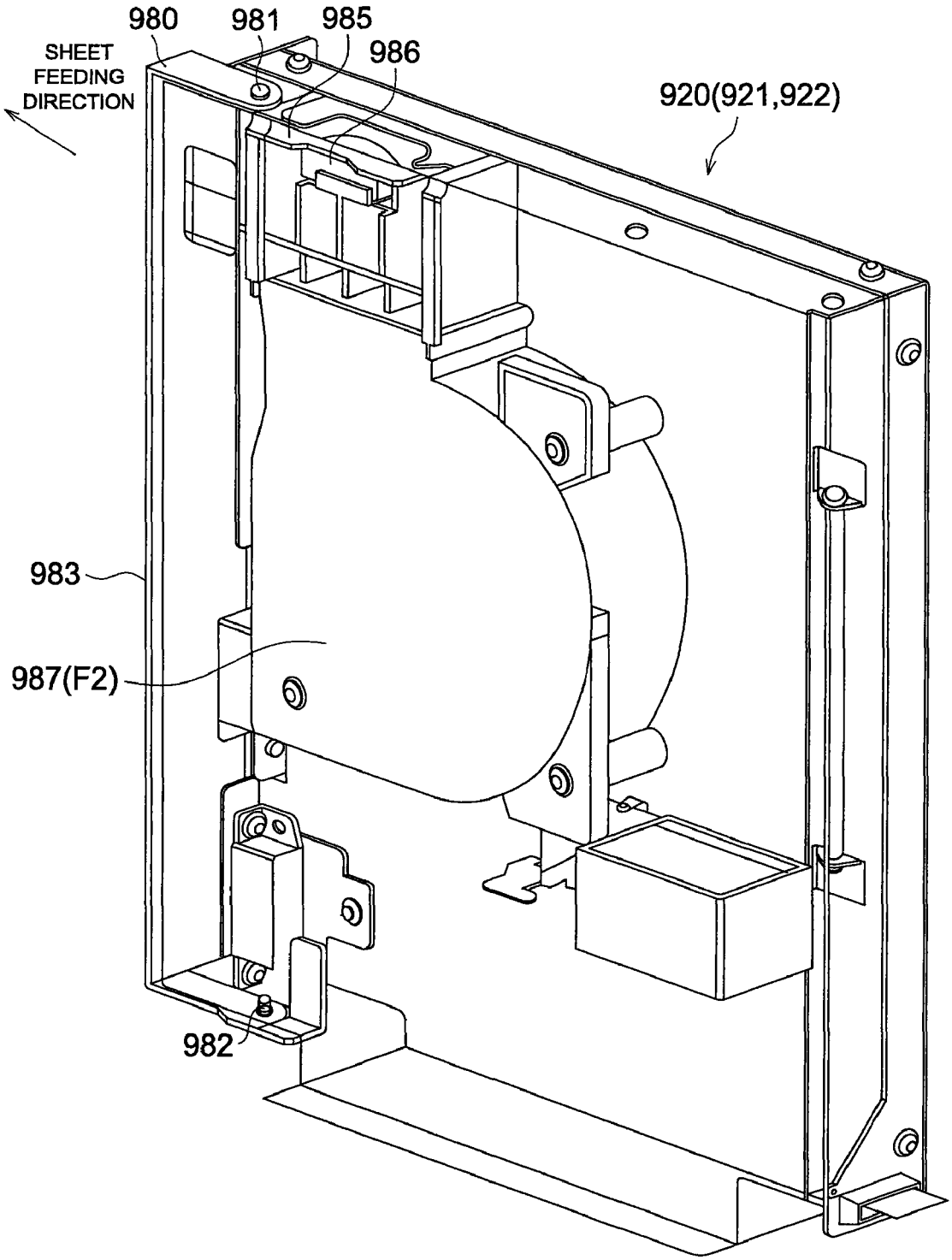
FIG. 8 is a perspective view representing the structure of the regulating member of the first embodiment.

Going back to the previous description, the following briefly describes the structure of the side regulating member of the first embodiment with reference to FIG. 8 and the aforementioned description.

For the sake of expediency, only one of the pairs is illustrated because of the same structures of the right and left side regulating members of FIG. 8.

The reference numeral 980 indicates the second side regulating member for the sheet having the minimum dimensions (e.g., postcard dimensions). This member occupies the illustrated retracted position and the position rotated 90 degrees in the counterclockwise direction wherein the pins 981 and 982 planted on the upper and lower positions of the first side regulating member 920 are used as fulcrums.

The side regulating member 980 regulates the side of the sheet having the minimum dimensions by means of the surface 983 at the position rotated 90 degrees from the retracted position.

When the aforementioned side regulating member 920 has enough traveling distance to regulate the sheet having the minimum dimensions, the second side regulating member 980 can be omitted, as a matter of course.

The reference numeral 985 denotes a flap arranged on the top of the side regulating member 920. This flap has a width and length sufficient to protrude to the upper surface (side) of the sheets to be stacked and stored.

The internal wall surface (upper portion on the side wall surface) of the side regulating member 920 (921, 922) located immediately below the flap 985 is provided with one end of the duct 986. The other end of the duct is connected with the casing 987 incorporating the air blowout fan F2 so as to communicate with each other.

The casing 987 and duct 986 are installed in the internal space formed between the internal and external walls constituting the side regulating member.

The air flow blown out through the duct 986 is directed to the sheet side surface closest to the uppermost one of the sheets guided and stacked by the flap 985, and serves to lift at least the uppermost sheet.

To put it another way, if the suction region of the vacuum type belt SB is small, the A4 size sheet (longitudinal feed) or greater dimensions cannot be easily sucked onto on the vacuum type belt in some cases, even if the gap between the uppermost sheet and the lowest surface of the vacuum type belt is as small as 1 mm.

To solve this problem, it is possible to increase the capacity of the negative pressure source (sirocco fan F1) to suck sheets onto the vacuum type belt SB through the aforementioned duct box. However, this may involve new problems. For example, the size of the sheet feeding apparatus will have to be increased, or noise will increase.

It is also possible to increase the suction region of the vacuum type belt SB. However, this requires an increase in the minimum dimensions of the paper used, for the very structure of the sheet feeding apparatus of the present embodiment. Thus, expected specification advantages will not be obtained.

The presence of the air blowout fan F2 in the sheet feeding apparatus of the present invention serves to provide the force of lifting the paper from both sides in addition to the suction by a negative pressure source (sirocco fan), despite the greater size of the paper. This structure ensures the paper to be firmly sucked onto the vacuum type belt SB.

To put it another way, the present invention minimizes an increase in the size of the sheet feeding apparatus and noise, and ensures a stable supply of paper ranging from the paper having the minimum dimensions exemplified by a postcard's dimensions (longitudinal feed) to the paper of the maximum dimensions exemplified by A3 size (longitudinal feed).

The air blowout fan F2 is required to be operated only when paper cannot be sucked onto the vacuum type belt by the negative pressure of the negative pressure source for the vacuum type belt alone.

One end of the duct connected with the separation fan can be faced to the upper portion (at the center in the direction of depth) on the front wall (described with reference to the structure of FIG. 2) of the sheet tray wherein the leading edge of the paper is regulated, whereby the uppermost sheet is encouraged to be separated from the bundle of sheets by air flow during the operation.

Figure 9:
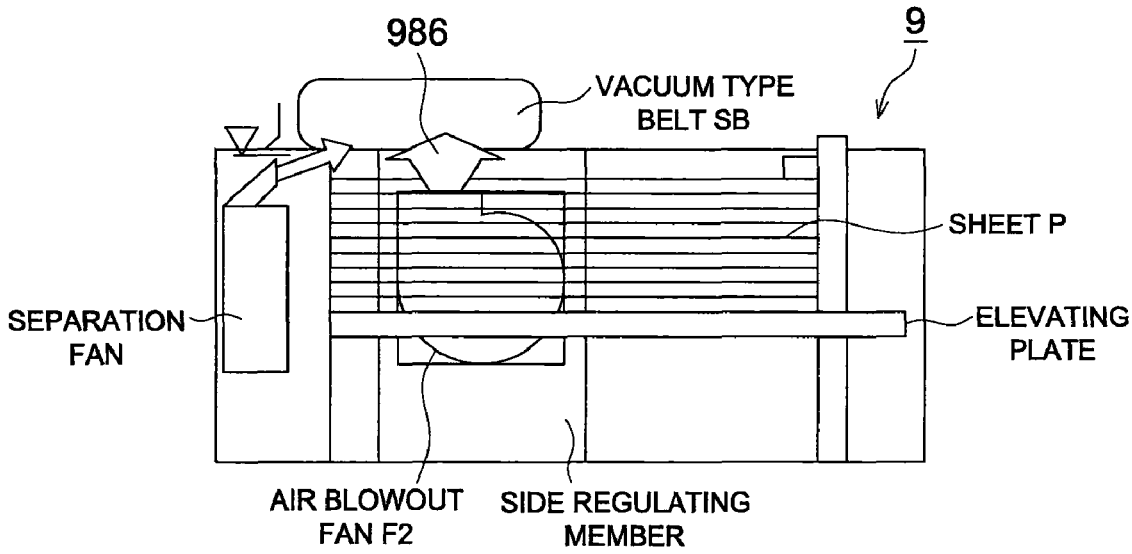
FIG. 9 is a conceptual diagram showing the housinghousing provided with a separation fan.

FIG. 9 is a conceptual diagram showing the housing provided with a separation fan.

In the embodiment of the present invention, the top end of the sheet side regulating member is higher than the lowermost surface of the vacuum type belt when sheets are fed. This structure easily eliminates the possibility of the upper sheets being misaligned or lost.

Further, the sheet tray can be pulled out perpendicular to the direction of feeding the sheet by the vacuum type belt. This structure enhances user convenience.

In another embodiment of the present invention, the sheet feeding apparatus provided is capable of minimizing the misalignment of the upper sheets, and can be easily connected with the image forming apparatus whenever required. This structure improves the functions of the image forming apparatus.

In still another embodiment of the present invention, the sheet feeding apparatus provided is capable of minimizing the misalignment of the upper sheets. This structure provides stable high-quality images at all times and allows a great number of images to be formed.

In the description of the present embodiments, the conventionally known technique can be used to cover the structure of moving the side regulating member in the longitudinal direction, and detailed description has been omitted.

It is to be expressly understood that the present invention is not restricted to the aforementioned embodiments. The present invention can be embodied in a great number of variations with appropriate modifications or additions, without departing from the technological spirit and scope of the invention claimed.

What is claimed is:

1. A sheet feeding apparatus comprising:

a sheet tray for stacking and storing a plurality of sheets of paper, the sheet tray capable of being pulled out in a direction perpendicular to a sheet feed direction;

a pair of side regulating members for regulating both lateral surfaces of the sheets, the regulating members being provided over the sheet tray and perpendicular to the sheet feed direction;

a vacuum belt provided between the pair of side regulating members to suck a sheet of paper from above the sheets of paper stacked on the sheet tray and feed the sheets of paper; and a moving mechanism for moving the vacuum belt or one of the pair of side regulating members that is provided on a back side of the other of the pair of side regulating members in the direction of pulling out the sheet tray in the vertical directions, in such a way that, when the feeding of sheets inside the sheet tray is enabled, the uppermost ends of the side regulating members are higher than the lowermost surface of the vacuum belt and when the sheet tray is pulled out, the uppermost end of the side regulating member provided on the back side is lower than the lowermost surface of the vacuum belt.

2. The sheet feeding apparatus of claim 1, wherein the moving mechanism is a vacuum belt moving device which moves the vacuum belt in vertical directions.

3. The sheet feeding apparatus of claim 2, wherein the vacuum belt moving mechanism comprises a cam and a cam follower arranged between the sheet tray and the vacuum belt.

4. The sheet feeding apparatus of claim 2, wherein the vacuum type belt is swingable around a shaft.

5. The sheet feeding apparatus of claim 1, wherein the moving mechanism is a side regulating member moving device.

6. The sheet feeding apparatus of claim 5, wherein the side regulating member moving device comprises a cam and a cam follower both are arranged between a main body side of the sheet feeding apparatus sheet and the side regulating member provided on the back side.

7. The sheet feeding apparatus of claim 5, wherein the side regulating member provided on the back side comprises an elastic body which biases upward the side regulating member and a guide member which guides displacement of the side regulating member in the vertical direction.

8. The sheet feeding apparatus of claim 1, wherein the a size of the vacuum belt in a direction perpendicular to the sheet feed direction is smaller than a size of the sheets of paper stacked on the sheet tray in a direction perpendicular to the sheet feed direction.

9. The sheet feeding apparatus of claim 1, wherein a flap is arranged on the top of the side regulating member which protrudes to the upper surface of the sheets stacked on the sheet tray.

10. A housing comprising:

a sheet feeding apparatus, the sheet feeding apparatus comprising:

a sheet tray for stacking and storing a plurality of sheets of paper, the sheet tray capable of being pulled out in a direction perpendicular to a sheet feed direction;

a pair of side regulating members for regulating both lateral surfaces of the sheets, the regulating members being provided over the sheet tray and perpendicular to the sheet feed direction;

a vacuum belt provided between the pair of side regulating members to suck a sheet of paper from above the sheets of paper stacked on the sheet tray and feed the sheets of paper; and a moving mechanism for moving the vacuum belt or one of the pair of side regulating members that is provided on a back side of the other of the pair of side regulating members in the direction of pulling out the sheet tray in the vertical directions, in such a way that, when the feeding of sheets inside the sheet tray is enabled, the uppermost ends of the side regulating members are higher than the lowermost surface of the vacuum belt and when the sheet tray is pulled out, the uppermost end of the side regulating member provided on the back side is lower than the lowermost surface of the vacuum belt;

wherein the housing is adapted to be used in the form integrally combined with an image forming apparatus.

11. The housing of claim 10, wherein a plurality of the sheet feeding apparatuses are incorporated in the housing.

12. An image forming apparatus integrally comprising:

a housing comprising a sheet feeding apparatus; and an image forming section which forms an image on a sheet fed from the sheet feeding apparatus, the sheet feeding apparatus comprising:

a sheet tray for stacking and storing a plurality of sheets of paper, the sheet tray capable of being pulled out in a direction perpendicular to a sheet feed direction;

a pair of side regulating members for regulating both lateral surfaces of the sheets, the regulating members being provided over the sheet tray and perpendicular to the sheet feed direction;

a vacuum belt provided between the pair of side regulating members to suck a sheet of paper from above the sheets of paper stacked on the sheet tray and feed the sheets of paper; and a moving mechanism for moving the vacuum belt or one of the pair of side regulating members that is provided on a back side of the other of the pair of side regulating members in the direction of pulling out the sheet tray in the vertical directions, in such a way that, when the feeding of sheets inside the sheet tray is enabled, the uppermost ends of the side regulating members are higher than the lowermost surface of the vacuum belt and when the sheet tray is pulled out, the uppermost end of the side regulating member provided on the back side is lower than the lowermost surface of the vacuum belt.

* * * * *